United States Patent [19]

Helmstetter

[11] Patent Number: 5,042,806

[45] Date of Patent: Aug. 27, 1991

[54] GOLF CLUB WITH NECKLESS METAL HEAD

[75] Inventor: Richard C. Helmstetter, Carlsbad, Calif.

[73] Assignee: Callaway Golf Company, Carlsbad, Calif.

[21] Appl. No.: 458,962

[22] Filed: Dec. 29, 1989

[51] Int. Cl.[5] ..... A63B 53/04

[52] U.S. Cl. ..... 273/80.2; 273/167 A; 273/167 H; 273/167 K

[58] Field of Search ..... 273/167–175, 273/80.2–80.9, 77 A; 29/428, 525

[56] References Cited

U.S. PATENT DOCUMENTS

| | | | |
|---|---|---|---|
| D. 225,419 | 12/1972 | Mills | D21/214 |
| D. 277,211 | 1/1985 | Kobayashi | D21/214 |
| 1,555,425 | 9/1925 | McKenzie | 273/169 |
| 1,868,286 | 7/1932 | Grieve | 273/174 |
| 2,020,048 | 11/1935 | Cook et al. | 273/80.7 X |
| 2,041,676 | 5/1936 | Gallagher | 273/77 |
| 2,083,189 | 6/1937 | Crooker | 273/77 R |
| 2,458,920 | 1/1949 | Wheeler et al. | 273/80.7 |
| 3,068,011 | 12/1962 | Sano | 273/174 |
| 3,625,518 | 12/1971 | Solheim | 273/175 |
| 3,640,534 | 2/1972 | Mills | 273/80.7 |
| 3,761,095 | 9/1973 | Thompson | 273/174 |
| 3,810,621 | 5/1974 | Mills | 273/80.2 |
| 3,819,181 | 6/1974 | Mills | 273/80.2 |
| 4,214,754 | 7/1980 | Zebelean | 273/167 H |
| 4,313,607 | 2/1982 | Thompson | 273/167 H |
| 4,319,752 | 3/1982 | Thompson | 273/171 |
| 4,429,879 | 2/1984 | Schmidt | 273/167 H |
| 4,438,931 | 3/1984 | Motomiya | 273/167 H |
| 4,756,534 | 7/1988 | Thompson | 273/171 |

FOREIGN PATENT DOCUMENTS

| | | | |
|---|---|---|---|
| 26072 | 9/1912 | United Kingdom | 273/80.2 |
| 160030 | 3/1921 | United Kingdom | 273/167 A |
| 420332 | 11/1934 | United Kingdom | 273/80.8 |

*Primary Examiner*—Edward M. Coven
*Assistant Examiner*—Sebastiano Passaniti
*Attorney, Agent, or Firm*—William W. Haefliger

[57] ABSTRACT

A golf club, of the "metal wood" type, includes a shaft attached to a head that is formed from a foam-filled metal shell. The shell has a heel portion that includes a substantially continuous hollow internal tube extending from the top surface of the shell to the bottom surface that forms the sole of the club head. The shaft extends through the entire length of the tube, with the end of the shaft lying flush with the sole, thereby eliminating the need for a hosel to connect the shaft to the head. The elimination of the hosel allows substantially all of the mass of the club head to be "effective mass", which contributes to the transfer of energy from the player to the ball, for greater shot distance. The extension of the shaft to the sole provides dramatically increased "head feel" for greater shot control. The hosel-less structure is advantageously combined with a sole that has upwardly-angled flats at the toe end, the heel end, and the trailing edge, with a rounded rail from the trailing edge flat to the face of the club. This sole structure provides improved short control, especially from bad lies.

14 Claims, 2 Drawing Sheets

GOLF CLUB WITH NECKLESS METAL HEAD

BACKGROUND OF THE INVENTION

This invention relates to the field of golf clubs. More specifically, it relates to a "metal wood" club with an improved club head.

The goals of improving one's golf game and increasing a player's competitive advantage have led to many improvements in the design of golf clubs over the years. A relatively recent development is that of the "metal wood". Traditionally, woods (clubs usually used for tee shots and longer fairway shots) have had heads made of a hard wood, the preferred wood being persimmon. The tendency of wood to warp or split, however, coupled with increasing costs of material and labor, led to the development of metal heads for the woods. As disclosed, for example, in U.S. Pat. Nos. 4,313,607 and 4,319,752, both to Thompson, such metal wood heads typically comprise a hollow cast steel shell filled with a synthetic plastic foam material.

The metal wood has achieved a large measure of success in terms of acceptance and use by skilled golfers. Nevertheless, many golfers still prefer traditional, "wooden" woods, because of what they consider to be non-optimal weight distribution in metal wood heads. Specifically, a very important element of club head design is the concentration of as much of the mass of the head as possible into the face of the club head and the portion of the head behind the face. This puts the mass of the head where it effectively contributes to the energy imparted to the ball, rather than being merely "deadweight" that limits the velocity of the club head when it is swung. In other words, such a distribution of mass in the club head increases the effective mass of the head, without increasing its total mass. Maximizing the effective mass of the club head without significantly increasing its total mass results in little or no loss in the achievable club head velocity. The result is greater shot distance, since the energy imparted to the ball by the club is proportional to the effective mass of the club head times the square of the club head velocity.

Conventional metal woods have a substantial portion (typically about ten percent) of the total club head mass in the neck or hosel, where the head is attached to the shaft. The mass of the hosel is "deadweight" that does not contribute to the transfer of energy to the ball, but only reduces the achievable club head velocity. For example, a typical metal wood head having a total mass of about 204 grams has about 22 grams in the hosel, yielding an effective mass of about 182 grams.

Another disadvantage to conventional metal wood club heads is that the thickness of the metal shell at the face is usually insufficient to allow any appreciable degree of "shaping". "Shaping" is the grinding or machining of the face to "fine tune" its curvature to alter the type and degree of spin imparted to the ball when the ball is struck toward the heel or toe ends of the face. Proper "shaping" can counteract the hooking and slicing effects of toe and heel shots, while also allowing fine adjustments in the pitch of the club. Because there are limitations on the total mass of the club head (due to the need to maximize achievable head velocity), and because a significant portion of the mass must be apportioned to the "deadweight" of the hosel, there is little or no extra mass available for thickening the shell wall at the club face.

Another disadvantage of metal woods is that of reduced "head feel", the tactile sense of the location of the face of the club head with respect to the ball, as compared to traditional persimmon woods. This reduced head feel is the result of having the end of the shaft located in the hosel, above the club face. The effect is that the skilled player is less able to "work the ball" with the face of the club through this sense of head feel.

Thus, there has been a long-felt need for a metal wood club head with optimal mass distribution that minimizes "deadweight", while allowing greater thickness in the shell at the face, and which provides a level of "head feel" approaching that of persimmon wood club heads.

SUMMARY OF THE INVENTION

Broadly, the present invention is a "metal wood" golf club having a shaft that is attached to a metal head, wherein the head has a substantially continuous hollow tube extending through the heel portion, from the top surface to the sole, or bottom surface, and wherein the tube receives the shaft throughout the length of the tube, so that the bottom end of the shaft is substantially flush with the sole of the head.

More specifically, the golf club head of the present invention comprises a foam-filled metal shell having a striking surface, a sole, a top surface, a rear surface, a heel portion, and a toe portion, wherein the heel portion includes the above-mentioned hollow tube that obviates the need for a hosel to connect the shaft to the head. The head is further characterized by the shell having a wall thickness at the striking surface that is substantially greater than the thickness of the wall throughout the rest of the club head. In addition, the hollow tube in the heel portion includes an internal orifice through which the foam is introduced into the interior of the shell during the fabrication of the head.

The above-described structure yields a number of advantages over conventional metal woods. First, by eliminating the hosel, the effective mass of the club head is essentially equal to its total mass, the deadweight being substantially removed. Furthermore, the elimination of the hosel allows the striking surface or face of the club head to have a thicker wall than the rest of the head, thereby offering more material for "shaping", without adding to the total mass of the club. In addition, by having the shaft extend all the way through the heel of the head, terminating flush with the sole, there is a substantial improvement in head feel, as compared to metal woods having a hosel, thereby improving the player's control of the shot, and his or her ability to "work" the ball. Moreover, the additional shaft length (about 3.5 to 4.0 cm) allowed by the elimination of the hosel provides an improvement in shaft action, as compared to clubs with a hosel.

The invention is further characterized by a number of improvements in the configuration of the sole. Specifically, the trailing edge of the sole includes a first upwardly-angled "flat" that minimizes the closing or "hooding" of the club on impact when the ball is hit "fat", while reducing aerodynamic drag. There is a rounded rail in the center of the sole, extending from the beginning of the trailing edge flat to the face of the head, which guides the head straight through impact, even if the ball is hit slightly "fat", or is hit out of the rough or sand. Extending from the rail to the toe of the club head is a second upwardly-angled flat, and extending from the rail to the heel of the head is a third upwardly-angled flat. The second and third flats offer improved ability to hit accurate shots from uneven and sidehill lies.

The improvements and advantages described above, and others, will be better appreciated from the detailed description that follows.

DETAILED DESCRIPTION OF A PREFERRED EMBODIMENT

Figure 3:
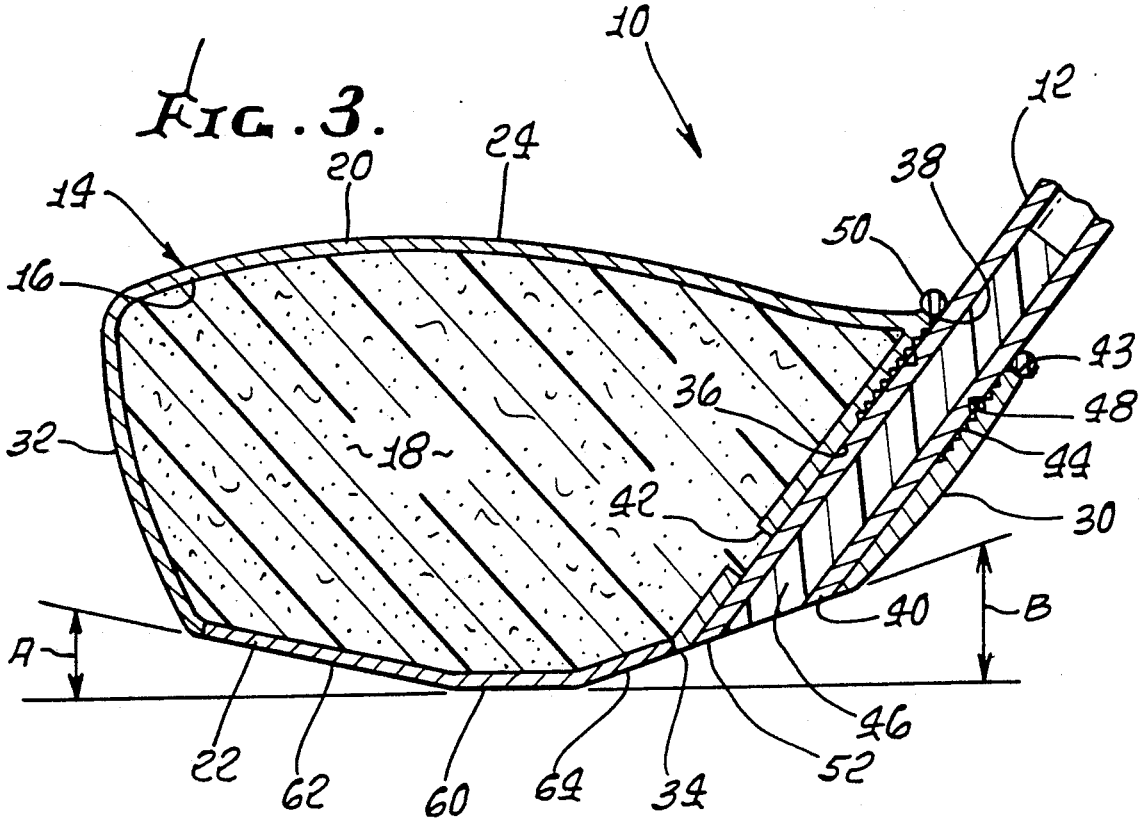
FIG. 3 is a cross-sectional view taken along line 3—3 of FIG. 2.
Figure 4:
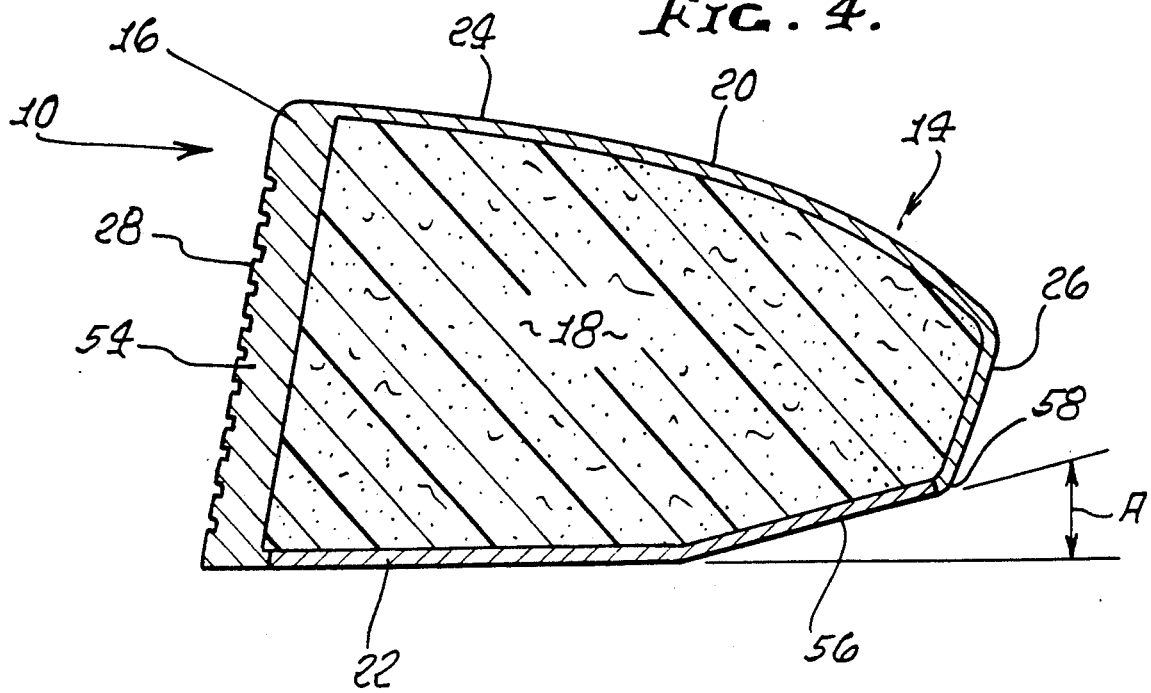
FIG. 4 is a cross-sectional view taken along line 4—4 of FIG. 2.

Referring now to the drawings, a golf club 10, in accordance with a preferred embodiment of the present invention, is shown. The club 10 includes a shaft 12 (only the lower portion of which is shown), which is attached to a head 14. The head 14 is in the configuration of a "wood" club, although it is made of metal. As shown in FIGS. 3 and 4, the head comprises a hollow metal shell 16, which is filled with a plastic foam filling 18, preferably polyurethane.

The shell 16 is preferably made of stainless steel, and it may be fabricated by the "lost wax" casting method that is well-known in the art. The shell 16 is formed in two pieces: a main portion 20, and a sole plate 22 that is welded to the main portion 20.

Figure 1:
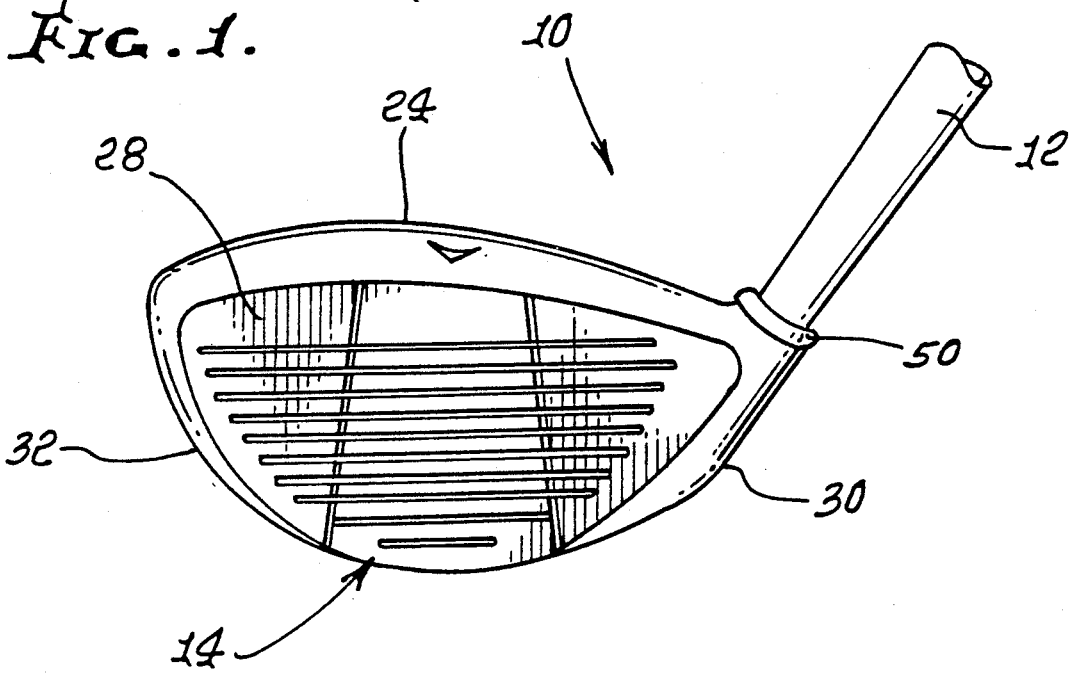
FIG. 1 is a front elevational view of a metal wood golf club in accordance with a preferred embodiment of the present invention, showing the head and the lower portion of the shaft.
Figure 2:
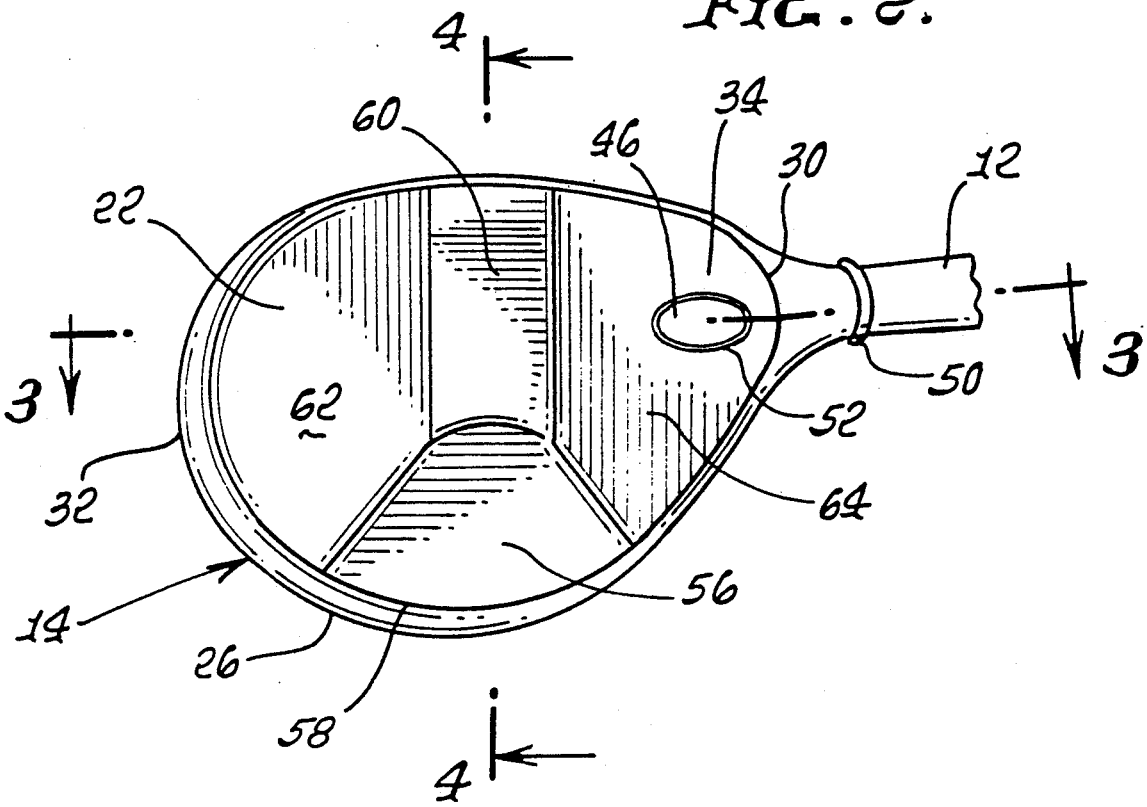
FIG. 2 is a bottom plan view of the golf club shown in FIG. 1.

The main shell portion 20 has a top surface 24, a rear surface 26, and a striking surface or face 28 opposite the rear surface 26. The face 28 is angled with respect to the vertical with a specified "pitch" that is determined by the type of club and the amount of loft desired. The end portion of the head 14 proximate the shaft 12 is commonly termed the "heel" 30, while the end portion opposite the heel 30 is termed the "toe" 32. As shown in FIG. 2, the face 28 is typically curved from the heel 30 to the toe 32. The main shell portion 20 has a bottom corner portion 34 (shown in cross-section in FIG. 3) that is flush with the sole plate 22, and that forms a bottom surface or sole in combination with the sole plate 22 when the two shell portions are welded together.

Referring now to FIG. 3, the heel portion 30 of the shell 16 is provided with a substantially continuous hollow tube 36 that extends from an upper opening 38 in the top surface 24 to a lower opening 40 in the bottom surface or sole through the bottom corner portion 34 of the main shell portion 20. The tube 36 is of substantially uniform internal diameter, and its side wall is interrupted by an internal orifice 42 that opens into the interior of the shell. The orifice 42 provides an entrance for the introduction of the foam material 18 into the shell interior during the manufacturing process.

The tube 36 is dimensioned to receive the lower part of the shaft 12 with a snug fit. The upper opening 38 is provided with a radiused lip 43, as shown in FIG. 3, to minimize the possibility of stress fractures in the shaft due to impact against the edge of the opening. A portion of the interior wall of the tube 36, extending downwardly from the upper opening 38, is provided with striations, preferably in the form of internal threads 44, to provide a "glue lock" for better bonding of the shaft in the tube, as will be described below.

In the preferred embodiment of the invention, the lip 43 is at the end of a slight rise at the heel end of the head, the height of the rise being less than, or approximately equal to, the height of a horizontal plane defined by the highest point of the club head top surface 24.

The shaft 12 is a hollow tube made of any suitable material. Stainless steel is the most common material, but titanium and graphite-boron may also be used. If the shaft is of stainless steel, the exterior of the shaft may be chrome-plated to minimize corrosion. The lower part of the shaft is fitted with a plug 46 to prevent the entry of moisture into the interior of the shaft. The plug 46 may be of any suitable resilient material, such as nylon, epoxy, polyurethane, or Delrin. The plug 46 may be retained in the shaft by an annular crimp 48 in the shaft wall. The crimp 48 also serves as a glue lock, as will be discussed below. A locator ring 50, preferably of glass fiber-reinforced nylon, is adhesively bonded to the shaft at a distance above the bottom end 52 of the shaft approximately equal to the length of the tube 36.

The shaft 12 is attached to the head 14 by a suitable epoxy adhesive, the striations or threads 44 in the tube 36 and the crimp 48 in the shaft providing "glue locks", as mentioned above, for better adhesive bonding. (Any plating on the lower part of the shaft is first buffed off.) During assembly, the lower part of the shaft is inserted into the tube 36 until the locator ring 50 abuts against the radiused lip 43 at the upper tube opening 38. The bottom end 52 of the shaft 12 then extends slightly beyond the lower tube opening 40. This bottom end 52 is then cut and ground so as to be flush with the sole of the head, as shown in FIGS. 2 and 3.

The structure described above allows the shaft to be attached to the head without a neck or hosel. As a result, substantially all of the mass of the head is "effective mass" that contributes to the transfer of energy from the player to the ball, with little or no "deadweight" to reduce the attainable club head velocity. By increasing the effective mass of the club head without reducing the attainable velocity, there is a more effective transfer of energy to the ball from the player, yielding increased shot distance without an increase in effort on the part of the player.

Moreover, without a hosel, the lower part of the shaft extends all the way through the head, with the bottom end 52 of the shaft terminating flush with the sole. Thus, by eliminating the hosel, the shaft both enters and exits the head within the area defined between the top and bottom of the face of the club head, which area is sometimes called the "ball control zone". By bringing the lower end of the shaft within the ball control zone, and extending the shaft through to the sole of the club head, the tactile sense of the location of the club face, or "head feel", is maximized, yielding increased control of the shot, greater ability of the skilled player to "work" the ball, and a more solid feel of impact with the ball regardless of where on the face the ball is struck. The increase in effective mass of the club head plus the rigid support for the lower end of the shaft provided by the internal tube 36 in which the lower end of the shaft is received, further contribute to this improvement in "head feel".

Furthermore, a number of advantages in the manufacturing process can be achieved by eliminating the hosel. For example, the mass that would have been taken up by the hosel can be redistributed to a part of the club head where it can contribute to the effective mass of the head without increasing the total head mass. Optimally, this mass can be added by increasing the thickness of the shell wall at the face 28 of the club head, as shown in FIG. 4. This thickened shell, designated by the numeral 54, is preferably about four times the thickness of the rest of the shell wall, but this ratio can vary, depending upon a number of factors, and particularly the type of club. A further advantage of this thickened shell wall 54 at the face 28 is that there is sufficient metal for effective "shaping" of the face, by which is meant the grinding or machining of the face to fine tune its curvature, as previously discussed.

Still another advantage of eliminating the hosel is that there is a more even cooling of the club head in the mold. Where there is a hosel, by comparison, the hosel and the rest of the club head shell may cool at unequal rates, thereby resulting in a slight warping that can produce a lack of uniformity in loft, lie, and face angle from club head to club head.

A golf club in accordance with a preferred embodiment of the invention includes the sole configuration shown in the drawings.

Specifically, there is a first, or trailing edge, flat 56, which is a relieved, upwardly-angled flattened portion extending upwardly from a point approximately midway between the center of the sole and a trailing edge 58 at the juncture between the rear surface 26 of the club head and the sole plate 22. The lowermost part of the trailing edge flat 56 is contiguous with the interior end of a rounded rail 60 that extends forward to the bottom edge of the face 28 of the club head. Extending upwardly from one side of the rail 60 to the toe end 32 of the club head is a second relieved and flattened portion of the sole that may be termed a toe flat 62. Similarly, extending upwardly from the other side of the rail 60 to the heel end 30 of the club head is a third relieved and flattened portion that may be termed a heel flat 64.

The trailing edge flat 56 is preferably at an angle A of approximately 18 degrees with respect to the horizontal, while the toe flat 62 and the heel flat 64 are preferably at an angle B of approximately 19 degrees with respect to the horizontal. The angles A and B may be varied by plus or minus up to 5 degrees, depending on the type of club and the preferance of the player.

The purpose of the three flats 56, 62, and 64, and of the rail 60 is as follows: The rail 60 guides the club head in a straight line through impact with the ball, even if the ball is hit slightly "fat", or is hit out of the rough or sand. The trailing edge flat 56 minimizes the club head's closing, or "hooding" when the ball is hit "fat", while reducing the overall aerodynamic drag of the club head to maximize its attainable velocity during the swing. The toe flat 62 and the heel flat 64 facilitate shots from sidehill and uneven lies.

From the foregoing description, it will be appreciated that a golf club in accordance with the present invention offers a number of significant advantages over prior art "metal woods". For example, the effective club head mass is increased to nearly 100 percent of the total club head mass, thereby maximizing the efficiency of energy transfer from the player to the ball. By maximizing the effective club head mass, and by bringing the lower end of the shaft down through the entire club head and into the sole, through an internal tube in the club head, "head feel" is dramatically increased to the point where it is comparable to that attainable with high quality persimmon woods. The thickness of the club head shell in the face of the head can be markedly increased for improved shaping, without increasing the total mass of the head and thereby compromising attainable club head velocity. Greater uniformity in club head shape can be achieved by reducing warpage in the mold from unequal cooling of the hosel as compared to the rest of the shell. Finally, the shape of the sole helps to increase shot accuracy from uneven lies, the rough, and sand traps, while minimizing the deleterious effects on shot accuracy resulting from hitting the ball "fat", and while also providing excellent aerodynamic qualities for the club head to maximize attainable club head velocity during the swing.

The foregoing description is that of a preferred embodiment of the invention only. It will be appreciated that modifications of the disclosed embodiment will suggest themselves to those skilled in the pertinent arts. Such modifications should be considered within the spirit and scope of the invention, as defined in the claims that follow.

What is claimed is:

1. In a golf club, of the type including a head and a shaft with a first end, a portion of the shaft proximate said first end, being attached to a head, the head comprising a hollow metal shell having a ball striking front wall having a striking surface, a top wall, a bottom wall, a toe portion, and a heel portion furthest from said toe portion, said top wall being continuous from said toe portion to said heel portion and not extending above an uppermost level established by the top wall centrally of and above an uppermost extent of the ball striking front wall, the improvement comprising:

(a) a substantially continuous hollow metallic tube extending within said metal shell at the heel portion from the shell top wall to the shell bottom wall, said tube being integral with and terminating at said metal shell top wall, and having a bore, said heel portion including a heel wall merged with a rearwardmost extent of said tube, (b) the tube bore receiving a portion of the first end of the shaft throughout the length of the tube, the first end of the shaft being configured to lie substantially proximate the bottom surface of the shell bottom wall, (c) there being means mechanically and adhesively connecting the shaft periphery to the tube bore, and the tube bore having an upper end terminating proximate the level of said uppermost extent of said ball striking front wall, (d) and the tube having an uppermost rearward end defining an uppermost extent of said heel wall, proximate said level of the uppermost extent of said ball striking front wall.

2. The golf club of claim 1, wherein the striking surface is on a first shell portion that is substantially thicker than the other portions of the shell.

3. The golf club of claim 2, wherein the first shell portion is approximately four times thicker than the other shell portions.

4. The golf club of claim 1, wherein the tube has a side wall with an orifice communicating with the interior of the shell.

5. The golf club of claim 4, wherein the side wall of the tube has an interior surface that is provided with striation means for improving the adhesive bonding between the shaft and the tube.

6. The golf club of claim 5, wherein the striation means are formed as internal threads.

7. The golf club of claim 1, wherein the shell includes a main portion and a sole plate attached to the main portion, wherein the main portion forms the top wall, a rear surface, and the striking surface, and includes the heel portion and the toe portion, and wherein the sole plate forms the bottom wall.

8. The golf club of claim 7, wherein the sole plate comprises:

a trailing edge adjoining the rear surface of the main shell portion; and a first flattened portion extending upwardly to the trailing edge from a point approximately mid-way between the center of the sole plate and the trailing edge.

9. The golf club of claim 8, wherein the striking surface has a bottom edge adjoining the sole plate, and wherein the sole plate further comprises:

a rounded rail extending from the lowermost part of the first flattened portion to the bottom edge of the striking surface.

10. The golf club of claim 9, wherein the sole plate further comprises:

a second flattened portion extending upwardly from a first side of the rail to a toe end of the head defined by the toe portion; and a third flattened portion extending upwardly from a second side of the rail to a heel end of the head defined by the heel portion.

11. A method of attaching a foam-filled metal golf club head to a shaft, comprising the steps of:

(a) providing a foam-filled metal golf club head with a top surface, a bottom surface, a ball striking surface having an uppermost extent, a rear surface, a heel end, a toe end, and a substantially continuous hollow tube from the top surface through the bottom surface near the heel end, said tube being formed to have an upper end terminating proximate the level of said uppermost extent of said striking surface, said tube also being formed to have an uppermost rearward end defining an uppermost extent of said heel end proximate the level of said uppermost extent of said striking surface;

(b) attaching a locator ring to the shaft a predetermined distance from a first end of the shaft, (c) inserting the first end of the shaft into the tube with an adhesive material applied between the exterior surface of the shaft and the interior wall of the tube, the shaft being inserted so that the locator ring abuts against the top surface of the club head, and so that the first end of the shaft extends through the bottom surface, and (d) trimming the first end of the shaft so that it is substantially flush with the bottom surface.

12. The method of claim 11, wherein the step of providing the club head is followed by the step of internally threading at least a portion of the tube.

13. The method of claim 11, wherein the predetermined distance at which the locator ring is attached is approximately equal to the length of the tube.

14. In a golf club, of the type including a head and a shaft with a first end, a portion of the shaft proximate said first end being attached to a head, the head comprising a hollow metal shell having a ball striking front wall having a striking surface, a top portion, a bottom portion, a toe portion, and a heel wall furthest from said toe portion, said top portion being continuous from said toe portion to said heel portion and not extending above an uppermost level established by the top portion centrally of and above an uppermost extent of the ball striking front wall the improvement comprising:

(a) a substantially continuous hollow metallic tube extending lengthwise along a shell wall from the shell top portion to the shell bottom portion, said tube being integral with and terminating at said metal shell top portion and having a bore, (b) the tube bore receiving the shaft throughout the length of the tube, the first end of the shaft being configured to lie substantially proximate the bottom surface of the shell bottom portion, (c) there being means mechanically and adhesively connecting the shaft periphery to the tube bore, and the tube bore having an upper end terminating proximate the level of said uppermost extent of said ball striking front wall, (d) and the tube having a lengthwise extending wall integrated along its length with said shell wall so that the shell supports the tube along its length, and whereby metal otherwise required for the tube is used in the shell at locations between the tube and said toe portion.

* * * * *